US008814319B2

(12) United States Patent
Lebron et al.

(10) Patent No.: US 8,814,319 B2
(45) Date of Patent: Aug. 26, 2014

(54) PRINTING SYSTEM AND RELATED METHODS

(75) Inventors: Hector Jose Lebron, San Diego, CA (US); Spencer C. Anderson, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/980,547

(22) PCT Filed: Feb. 25, 2011

(86) PCT No.: PCT/US2011/026215

§ 371 (c)(1),
(2), (4) Date: Jul. 18, 2013

(87) PCT Pub. No.: WO2012/115654

PCT Pub. Date: Aug. 30, 2012

(65) Prior Publication Data

US 2013/0314465 A1 Nov. 28, 2013

(51) Int. Cl.
*B41J 2/165* (2006.01)

(52) U.S. Cl.
CPC ..... *B41J 2/165* (2013.01); *B41J 2/16517* (2013.01)
USPC ..... 347/22

(58) Field of Classification Search
USPC ..... 347/22, 23, 35, 5, 9
See application file for complete search history.

(56) References Cited

U.S. PATENT DOCUMENTS

| | | | | |
|---|---|---|---|---|
| 4,895,603 | A | 1/1990 | Semp et al. | |
| 5,903,288 | A | 5/1999 | Yamaguchi | |
| 5,975,689 | A | 11/1999 | Pawlowski, Jr. et al. | |
| 6,203,146 | B1 * | 3/2001 | Pawlowksi et al. | 347/85 |
| 6,604,811 | B2 | 8/2003 | Sawicki | |
| 7,887,167 | B2 * | 2/2011 | Comas et al. | 347/85 |
| 2002/0149634 | A1 | 10/2002 | Fujii et al. | |
| 2009/0128593 | A1 | 5/2009 | Jorba et al. | |
| 2010/0315463 | A1 | 12/2010 | Escude et al. | |

FOREIGN PATENT DOCUMENTS

| | | |
|---|---|---|
| JP | 2002144544 | 5/2002 |
| KR | 20080050119 | 6/2008 |
| TW | 200932565 | 8/2009 |

* cited by examiner

*Primary Examiner* — Huan Tran

(57) ABSTRACT

In one embodiment, a printing system includes a printhead module that has a printhead and a regulator chamber. The regulator chamber contains ink and a regulator air bag. The regulator air bag and the printhead are in fluid communication with the ink, and the printhead includes a plurality of ejection nozzles. The printing system includes a pressure source to inflate the air bag, thereby displacing an amount of ink sufficient to agitate menisci in the ejection nozzles without pushing ink out of the nozzles.

14 Claims, 4 Drawing Sheets

PRINTING SYSTEM AND RELATED METHODS

BACKGROUND

Inkjet printing technology is used in many commercial printing devices to provide high-quality image printing solutions at a reasonable cost. One type of inkjet printing known as "drop on demand" employs an inkjet pen to eject ink drops through a plurality of nozzles onto a print medium, such as a sheet of paper. The nozzles are typically arranged in arrays on one or more printheads on the pen, such that properly sequenced ejection of ink from the nozzles causes characters or other images to be printed on the print medium as the pen and the print medium move relative to each other. In a specific example, a thermal inkjet (TIJ) printhead ejects drops from a nozzle by passing electrical current through a heating element to generate heat and vaporize a small portion of the fluid within a firing chamber. In another example, a piezoelectric inkjet (PIJ) printhead uses a piezoelectric material actuator to generate pressure pulses that force ink drops out of a nozzle.

A continuing challenge with inkjet technology is maintaining the health of the nozzles. Printheads are typically capped or sealed in a high humidity environment during non-use to reduce drying of ink at the printhead nozzles. However, factors related to "decap" (i.e., the amount of time inkjet nozzles remain uncapped and exposed to ambient environments during use), such as evaporation of water or solvent can increase drying of the ink, resulting in clogging or partial blockage of the nozzles, or the formation of ink crust and/or viscous plugs in the nozzles. Clogged and blocked nozzles can alter the weights, velocities, trajectories, shapes and colors of ink drops being ejected from the nozzles, all of which can negatively impact the print quality of an inkjet printer.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview of Problem and Solution

Figure 1:
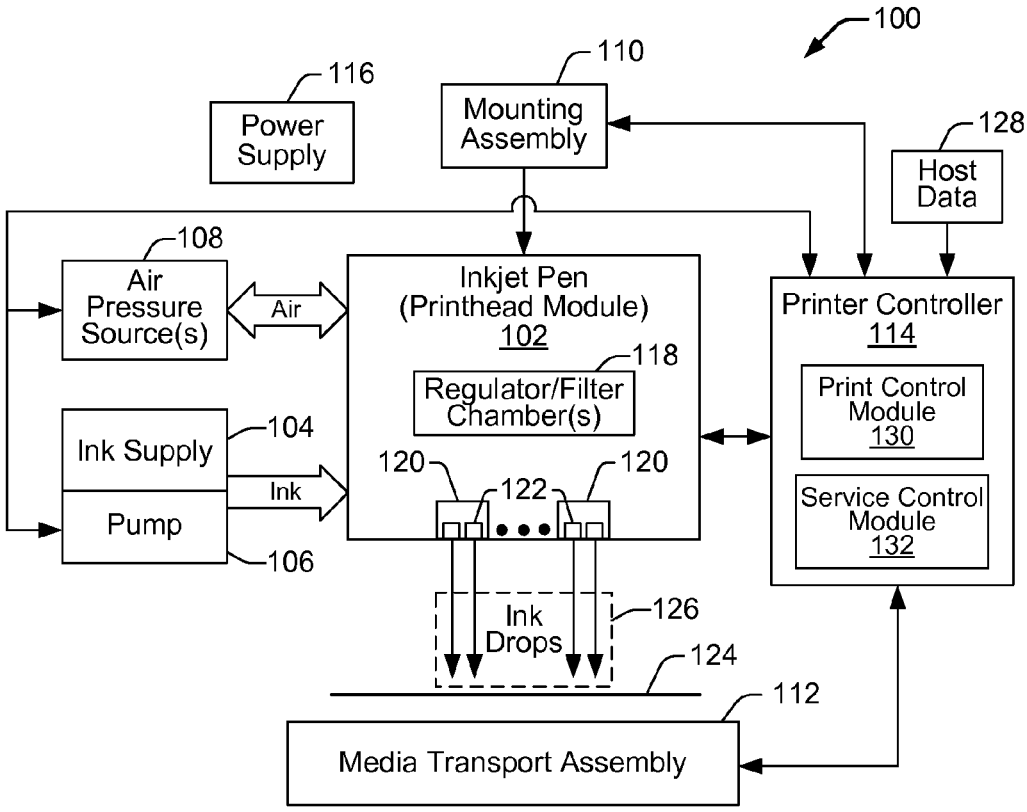
FIG. 1 shows an inkjet printing system suitable for implementing micro-priming events that disrupt ink menisci in inkjet ejection nozzles, according to an embodiment.

As noted above, one area of inkjet printing technology that continues to present challenges for improving the print quality of inkjet printing devices is the ability to maintain healthy (i.e., clean) inkjet ejection nozzles. Traditional methods of mitigating decap issues include using "service station" mechanisms to prime the nozzles and keep them clean. Blow priming is a method of servicing a printhead where ink is forced out of the nozzles to flush debris and/or air from the nozzles. In this servicing method a blow priming pump applies air pressure to the printhead pressure regulation system which forces ink out of the nozzles. Drawbacks to this servicing method include the need to remove excess ink from the nozzle plate after the priming event. Other methods include moving the printhead over a service station in order to spit the ink into a waste container, sometimes referred to as fly-by ink spitting. Both methods require additional time to move printheads over a spittoon or servicing area which results in interruptions to the printer work-flow, especially in printing systems that have shorter decap times. Such work-flow interruptions are typically not acceptable when dealing with high-throughput, industrial, one-pass printing systems. Another method includes printing a spit-bar onto the media. However, this is usually only done in roll-to-roll paper applications, as printing a spit-bar on cut sheet media is typically unacceptable to most customers. Printing directly onto the belt or table that carries the media is another alternative, but this can result in ink getting on the back of the media and can shorten the life of the belt or table. Another significant disadvantage with these printhead nozzle servicing methods is that they all yield ink and paper waste which increases overall printing costs and can be difficult to manage.

Embodiments of the present disclosure help to overcome disadvantages of prior nozzle servicing methods and systems generally by using a micro-priming method that disrupts the ink meniscus in nozzles without causing ink to be ejected from or drool from the nozzles. Air pressure pulses from a pressure source or pressure sources (e.g., such as blow-priming pumps) serve as micro-priming events that force a small volume of air into regulator air bags inside an inkjet pen. As the air pressure pulses inflate the regulator air bags, a small volume of ink is displaced within the regulator chamber (ink reservoir) of the pen which excites and disrupts the menisci in associated nozzles without ejecting or forcing ink out of the printhead. A controller is configured (e.g., through executable software instructions) to control the pulse lengths, dwell times and number of air pulses from the pressure source(s) based on operating characteristics of the inkjet pen, such as the ink rheology, operating temperature, and micro-fluidic architecture of the particular printhead. The brief meniscus disruption in each nozzle overcomes nozzle viscous plugs typically related to short term nozzle health issues (decap). The meniscus disruptions enable healthy first-drop ejections from the nozzles and improve overall print quality of the inkjet printing device.

In one example embodiment, a printing system includes a printhead module that has a printhead and a regulator chamber. The regulator chamber contains ink and a regulator air bag. The regulator air bag and the printhead are in fluid communication with the ink, and the printhead includes a plurality of ejection nozzles. The printing system includes a pressure source to inflate the air bag, thereby displacing an amount of ink sufficient to agitate menisci in the ejection nozzles without pushing ink out of the nozzles.

In another embodiment, a method of operating a printhead module includes forcing air pressure pulses into a first chamber of the printhead module. An air bag in the first chamber is inflated with the air pressure pulses and a volume of ink is displaced by inflating the air bag. Displacing the volume of ink excites ink menisci in first ejection nozzles associated with the first chamber without pushing ink out of the first nozzles.

In another embodiment, a printing system includes a printhead module. A plurality of chambers is in the module, and each chamber contains ink and an air bag. The printhead module includes a printhead having a plurality of ink slots, where each ink slot is in fluid correspondence with ink from one of the plurality of chambers. The system includes a plurality of pressure sources, each one being associated with one of the chambers. And the system includes a controller to cause a first pressure source to inflate a first air bag in a first chamber to displace a volume of ink in the first chamber sufficient to agitate menisci in ejection nozzles adjacent a first ink slot without pushing ink out of the ejection nozzles.

Illustrative Embodiments

FIG. 1 shows an inkjet printing system 100 suitable for implementing micro-priming events that disrupt ink menisci in inkjet ejection nozzles, according to an embodiment of the disclosure. Inkjet printing system 100 includes an inkjet pen or printhead module 102 (the terms "inkjet pen" and "printhead module" may be used interchangeably throughout this disclosure), an ink supply 104, a pump 106, an air pressure source or sources 108, mounting assembly 110, a media transport assembly 112, a printer controller 114, and at least one power supply 116 that provides power to the various electrical components of inkjet printing system 100. Printhead module 102 generally includes one or more regulator/filter chambers 118 that contain pressure control regulators to regulate ink pressure within the chambers 118 and one or more filters to filter ink. Printhead module 102 also includes at least one fluid ejection assembly or printhead 120 (e.g., a thermal or piezoelectric printhead 120) having a printhead die and associated mechanical and electrical components for ejecting drops of ink through a plurality of orifices or ink ejection nozzles 122 toward print media 124 so as to print onto print media 124. Printhead module 102 also generally includes a carrier that carries the printhead 120, provides electrical communication between the printhead 120 and printer controller 114, and provides fluidic communication between the printhead 120 and ink supply 104 through carrier manifold passages.

Nozzles 122 are usually arranged in one or more columns such that properly sequenced ejection of ink from the nozzles causes characters, symbols, and/or other graphics or images to be printed upon print media 124 as the printhead module 102 and print media 124 are moved relative to each other. A typical thermal inkjet (TIJ) printhead includes a nozzle layer arrayed with nozzles 122 and firing resistors formed on an integrated circuit chip/die positioned behind the nozzles. Each printhead 120 is operatively connected to printer controller 114 and ink supply 104. In operation, printer controller 114 selectively energizes the firing resistors to generate heat and vaporize small portions of fluid within firing chambers, forming vapor bubbles that eject drops of ink through nozzles 122 on to the print media 124. In a piezoelectric (PIJ) printhead, a piezoelectric element is used to eject ink from a nozzle. In operation, printer controller 114 selectively energizes the piezoelectric elements located close to the nozzles, causing them to deform very rapidly and eject ink through the nozzles.

Ink supply 104 and pump 106 form part of an ink delivery system (IDS) within printing system 100. In general, the IDS causes ink to flow to printheads 120 from ink supply 104 through chambers 118 in printhead module 102. In some embodiments the IDS may also include a vacuum pump (not shown) that together with the ink supply 104, pump 106 and printhead modules 102, form an ink recirculation system between the supply 104 and printhead module 102. In a recirculating system having a vacuum pump, portions of ink not consumed (i.e., ink not ejected) can flow back again to the ink supply 104. In other embodiments of a recirculating system, a single pump such as pump 106 can be used to both supply and recirculate ink in the IDS such that a vacuum pump may not be included.

Air pressure source 108 provides air pulses that force small volumes of air into regulator air bags in the regulator chambers 118 of printhead module 102. As discussed in more detail below, the small volumes of air inflate the regulator air bags which displace a small volume of ink in a reservoir within printhead module 102. The displacement of ink within printhead module 102 excites the meniscus in each of the nozzles associated with the ink reservoir, but does not eject or force ink out of the nozzles. Air pressure source 108 can be implemented, for example, as a blow priming pump such as is used in some inkjet printing systems to service printheads. Air pressure source 108 can also be implemented as a pump such as pump 106 used to pump ink from the ink supply 104 to the printhead module 102. In such an implementation, a pump 106 would be configured to supply air pressure pulses to regulator air bags in regulator chambers 118 of printhead module 102 as well as pressurized ink to an ink reservoir in printhead module 102.

Mounting assembly 110 positions printhead module 102 relative to media transport assembly 112, and media transport assembly 112 positions print media 124 relative to inkjet printhead module 102. Thus, a print zone 126 is defined adjacent to nozzles 122 in an area between printhead module 102 and print media 124. Printing system 100 may include a series of printhead modules 102 that are stationary and that span the width of the print media 124, or one or more modules that scan back and forth across the width of print media 124. In a scanning type printhead assembly, mounting assembly 110 includes a moveable carriage for moving printhead module(s) 102 relative to media transport assembly 112 to scan print media 124. In a stationary or non-scanning type printhead assembly, mounting assembly 110 fixes printhead module(s) 102 at a prescribed position relative to media transport assembly 112. Thus, media transport assembly 112 positions print media 124 relative to printhead module(s) 102.

Printer controller 114 typically includes a processor, firmware, and other printer electronics for communicating with and controlling inkjet printhead module 102, air pressure source(s) 108, ink supply 104 and pump 106, mounting assembly 110, and media transport assembly 112. Printer controller 114 receives host data 128 from a host system, such as a computer, and includes memory for temporarily storing data 128. Typically, data 128 is sent to inkjet printing system 100 along an electronic, infrared, optical, or other information transfer path. Data 128 represents, for example, a document and/or file to be printed. As such, data 128 forms a print job for inkjet printing system 100 and includes one or more print job commands and/or command parameters. In one example, printer controller 114 uses data 128 and executes printing instructions from a print control module 130 to control inkjet printhead module 102 and printheads 120 to eject ink drops from nozzles 122. Thus, printer controller 114 defines a pattern of ejected ink drops which form characters, symbols, and/or other graphics or images on print media 124. The pattern of ejected ink drops is determined by the print job commands and/or command parameters from data 128.

In one embodiment, printer controller 114 includes service control module 132 stored in a memory of controller 114. Service control module 132 includes servicing instructions executable on printer controller 114 (i.e., a processor of controller 114) to control servicing of printhead module 102, for example, by controlling nozzle priming events through the operation of air pressure source(s) 108. More specifically, controller 114 executes instructions from module 132 to control which air pressure sources are generating air pressure pulses (i.e., when there are multiple air pressure sources 108), the timing of the pulses (e.g., with respect to printing drop ejection events), the pulse lengths, the dwell times (i.e., the time between each air pressure pulse needed to deflate the regulator air bag) and the number of pulses being generated and directed through pressure regulator vents into regulator air bags or dedicated ink priming ports within printhead module 102. Service control module 132 instructions are specifically configured based on operating characteristics of the particular printhead module 102 in order to control the pulse lengths, dwell times and number of air pulses in a manner that achieves ink displacements within the printhead module 102 that cause disruptions of the ink meniscus in nozzles without causing ink to be ejected from or drool from the nozzles. Such characteristics can include, for example, rheology of the ink being used in printhead module 102, the operating temperature, and micro-fluidic architecture of the particular printhead 120.

In one embodiment, inkjet printing system 100 is a drop-on-demand thermal bubble inkjet printing system where the printhead 120 is a thermal inkjet (TIJ) printhead. The TIJ printhead implements a thermal resistor ejection element in an ink chamber to vaporize ink and create bubbles that force ink or other fluid drops out of a nozzle 122. In another embodiment, inkjet printing system 100 is a drop-on-demand piezoelectric inkjet printing system where the printhead 120 is a piezoelectric inkjet (PIJ) printhead that implements a piezoelectric material actuator as an ejection element to generate pressure pulses that force ink drops out of a nozzle 122.

Figure 2:
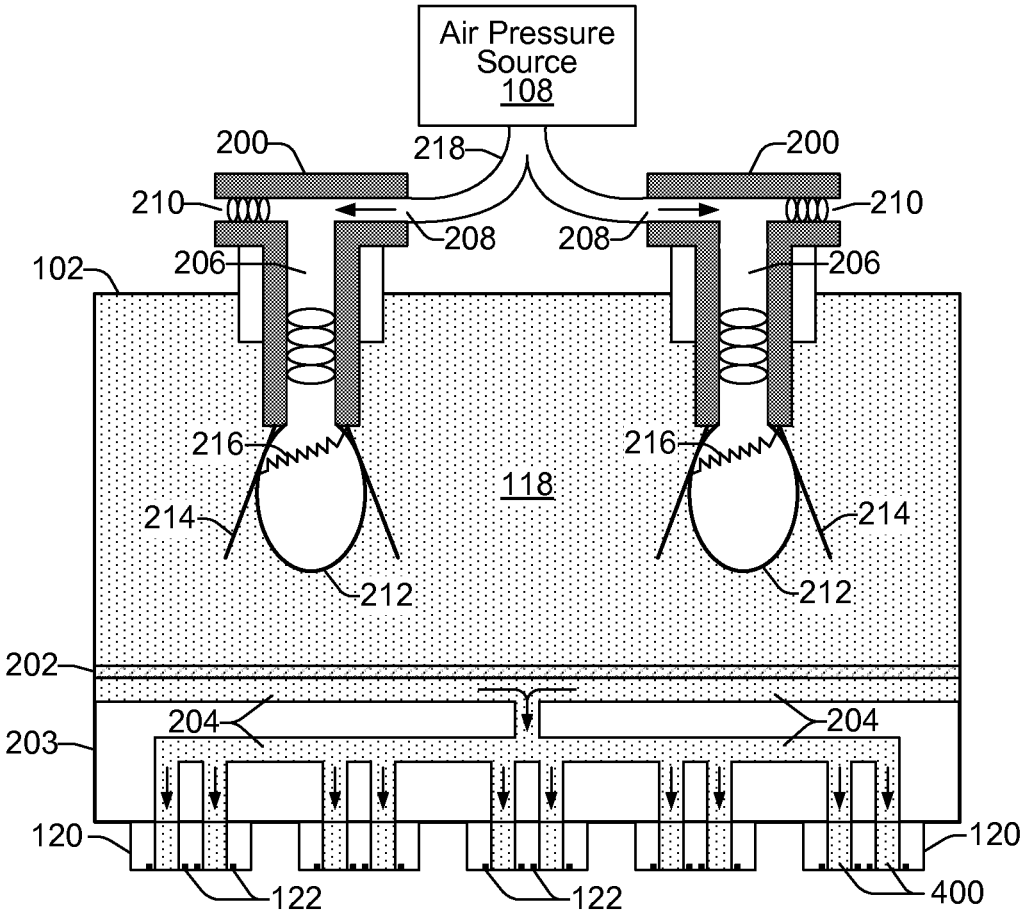
FIG. 2 shows a printhead module operatively coupled to an air pressure source, according to an embodiment.

FIG. 2 shows a printhead module 102 operatively coupled to an air pressure source 108, according to an embodiment. Printhead module 102 includes a regulator/filter chamber 118, two pressure control regulators 200, and one or more printheads 120. Regulator/filter chamber 118 serves as an internal ink reservoir 118 for the printhead module 102 to provide temporary storage of ink from ink supply 104 prior to ejecting the ink through nozzles 122 (the terms "regulator/filter chamber" and "ink reservoir" may be used interchangeably throughout this disclosure). Printhead module 102 also generally includes a filter 202 to filter ink prior to the ink passing into printheads 120, and a die carrier 203 having manifold passages 204 through which the ink passes to reach printheads 120.

In this embodiment, each pressure control regulator 200 includes three regulator vent openings: opening 206 to the printhead module 102, opening 208 to the air pressure source 108, and opening 210 to ambient air. Pressure control regulators 200 also include regulator air bags 212, regulator flaps 214 and regulator springs 216. Regulator air bags 210 are deployed within the chamber 118 (i.e., the internal ink reservoir 118) and are in fluid communication with the ink inside the chamber 118. Air pressure source 108 is operatively coupled to the passive vent openings 208 via an air tube 218, whereby a priming event causes pressurized air pulses (i.e., priming air pressure pulses) from the air pressure source 108 to pass through the air tube 218 and into regulator bags 212 through vent openings 208 and 206. Regulator bags 212 inflate as pressure source 108 forces air pressure pulses through the air tube 218 and the vent openings 208 and 206. As the regulator bags 212 inflate, they displace a small volume of ink within the chamber 118. The ink displacement within the chamber 118 propagates through the manifold passages 204 and ink slots 400, to the nozzles 122 in printheads 120 (see FIG. 4 discussion below), where it causes the ink meniscus in each of the nozzles 122 to bulge. The ink displacement is sufficient to bulge the menisci without causing ink to be ejected from or drool from the nozzles 122. The bulging of the menisci disrupts any viscous plugs or crusting that may be forming within the nozzles 122 and thereby primes the nozzles 122 to be ready to eject ink drops without interference.

Figure 3:
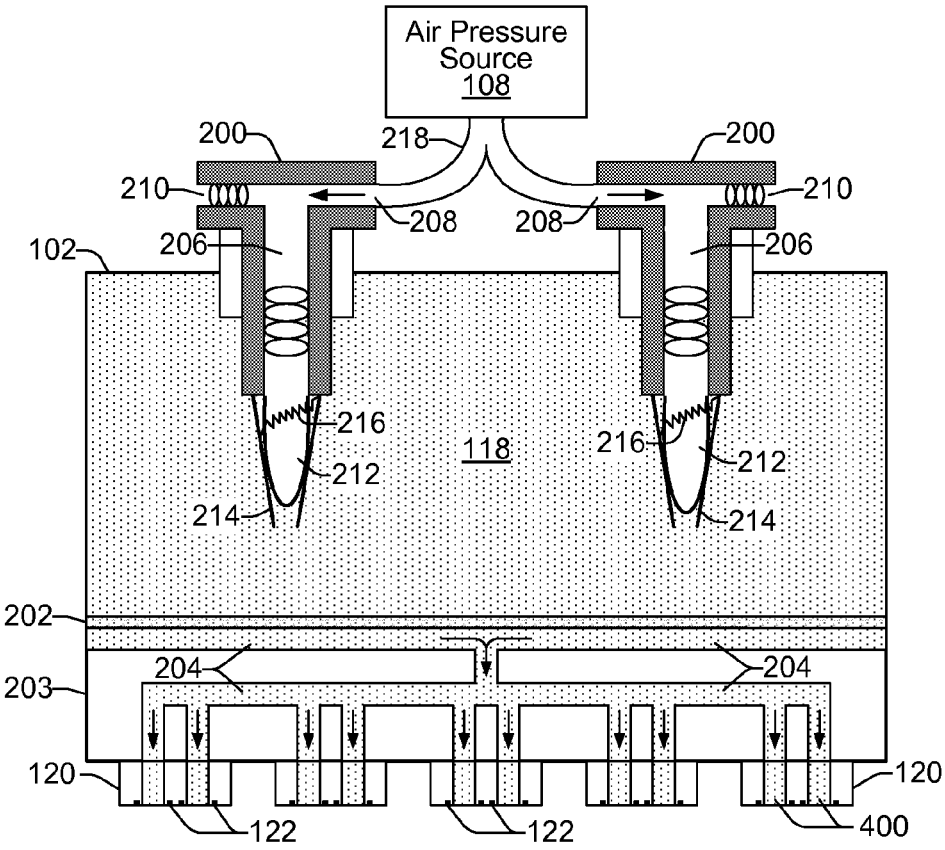
FIG. 3 shows a printhead module operatively coupled to an air pressure source that has stopped forcing air pressure pulses, according to an embodiment.

When the pressure source 108 stops forcing air pressure pulses through air tube 218, the regulator springs 216 pulling against the regulator flaps 214 cause the regulator bags 212 to deflate, as shown in FIG. 3. The priming air pressure in the regulator bags 212 is pushed back out of the bags through vent opening 206, and then to ambient air via vent opening 210. The deflation of the regulator air bags 212 allows the bulging meniscus to retract to its normal state again, which provides another disruption that helps prevent the formation of viscous plugs in the nozzles 122.

Figure 4:
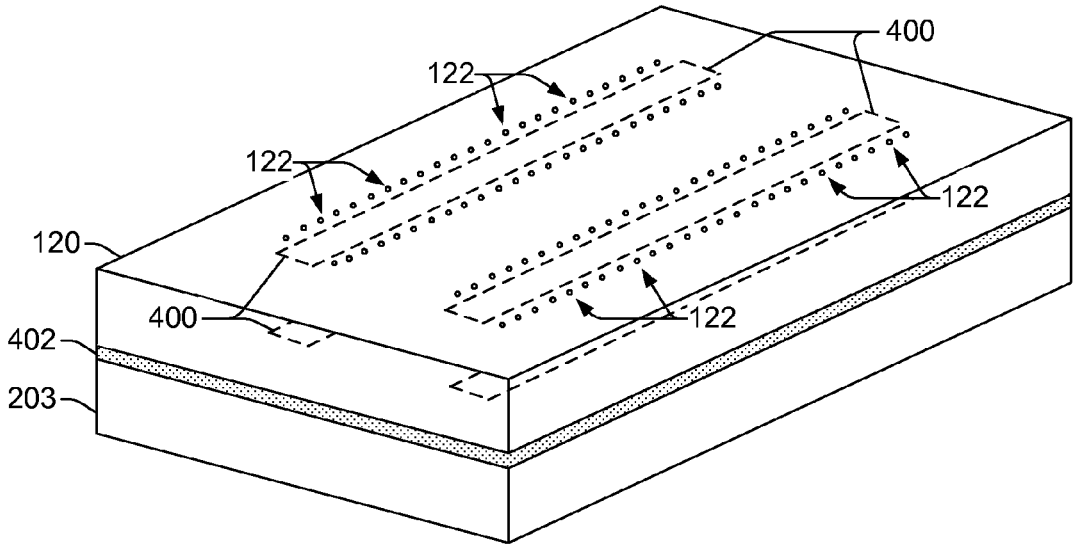
FIG. 4 shows a partial perspective view from the bottom of a printhead, according to an embodiment.
Figure 5:
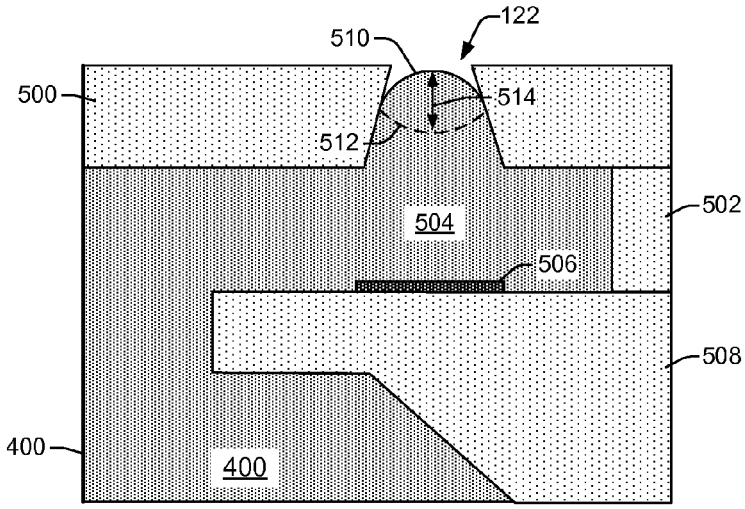
FIG. 5 shows a cross-sectional view of an individual printhead nozzle, according to an embodiment.

Referring primarily now to FIGS. 4 and 5, printhead 120 will be discussed in greater detail to help clarify the nozzle priming process of pressurizing regulator air bags 212 and bulging the menisci in the nozzles. FIG. 4 shows a partial perspective view from the bottom of a printhead 120, according to an embodiment. Although printhead 120 is shown throughout this disclosure with nozzles 122 arrayed in columns around two ink slots 400, the principles discussed herein are not limited in their application to a printhead having the particular configuration shown. Rather, other printhead configurations are possible, such as printheads with one ink slot, or printheads with more than two ink slots, and so on. As mentioned above, a die carrier 203 has manifold passages through which ink from the regulator chamber 118 reaches printheads 120. The die carrier 203 and printhead 120 are typically adhered to one another by an adhesive layer 402. Prior to reaching the printhead nozzles 122, ink from regulator chamber 118 flows through manifold passages in carrier 203 and ink slot 400. Dashed lines 400 are intended to represent the approximate location of ink slots 400 within the die carrier 203.

FIG. 5 shows a cross-sectional view of an individual printhead nozzle 122, according to an embodiment. In this example the nozzle 122 is one of many nozzles arrayed in columns around an ink slot 400. In general, the nozzle 122 is formed in a nozzle plate 500 disposed over a chamber layer 502. The nozzle 122 is located over an ejection chamber 504 formed in the chamber layer 502, and over an ejection element 506 (e.g., a thermal resistor or piezo-electric actuator) formed on a substrate 508. As noted above with reference to FIG. 2, during a priming event when pressure source 108 forces air pressure pulses into regulator bags 212, the inflating bags displace a small volume of ink within the regulator chamber 118. The displaced volume of ink propagates to the nozzles 122 in printhead 120, causing the ink meniscus 510 in each nozzle to bulge outward as shown in FIG. 5. Note that the amount of ink displacement is sufficient to bulge the meniscus outward, but is too little to cause ink to be ejected from or drool from the nozzles 122.

The dashed line 512 represents the location of the meniscus in its normal state (i.e., when no priming event is occurring), which is where the meniscus generally returns after a priming event is completed, when the pressure source 108 stops forcing air pressure pulses into regulator air bags 212 and the bags are allowed to deflate due to regulator springs 216 pulling against the regulator flaps 214 as shown in FIG. 3. The deflating regulator bags 212 cause the bulging meniscus to retract to its normal state. During priming events as the meniscus 510 is exercised or agitated in this manner, between its normal resting state and a state where it bulges outward, viscous plugs and other related "decap" issues are disrupted, leaving the nozzles 122 primed and ready to eject ink drops without interference.

Referring generally to the printhead module 102 discussed above with regard to FIGS. 2-5, both of the pressure control regulators 200 are controlled simultaneously by a common air pressure source 108. However, it is not advantageous to eject ink drops from nozzles during priming of the nozzles. If an ejection event occurs at the same time as a priming event, the ejected ink drop will be affected by the additional energy propagating through the ink as a result of the priming event. For example, the drop weight, velocity and shape may be non-uniform with respect to normal ink drop parameters. Therefore, while the embodiments of FIGS. 2-5 provide the benefit of priming ejection nozzles without ejecting or drooling ink from the nozzles, they can result in a non-optimum drop ejection frequency from the nozzles in order to avoid a simultaneous occurrence of an ejection event and a priming event.

Figure 6:
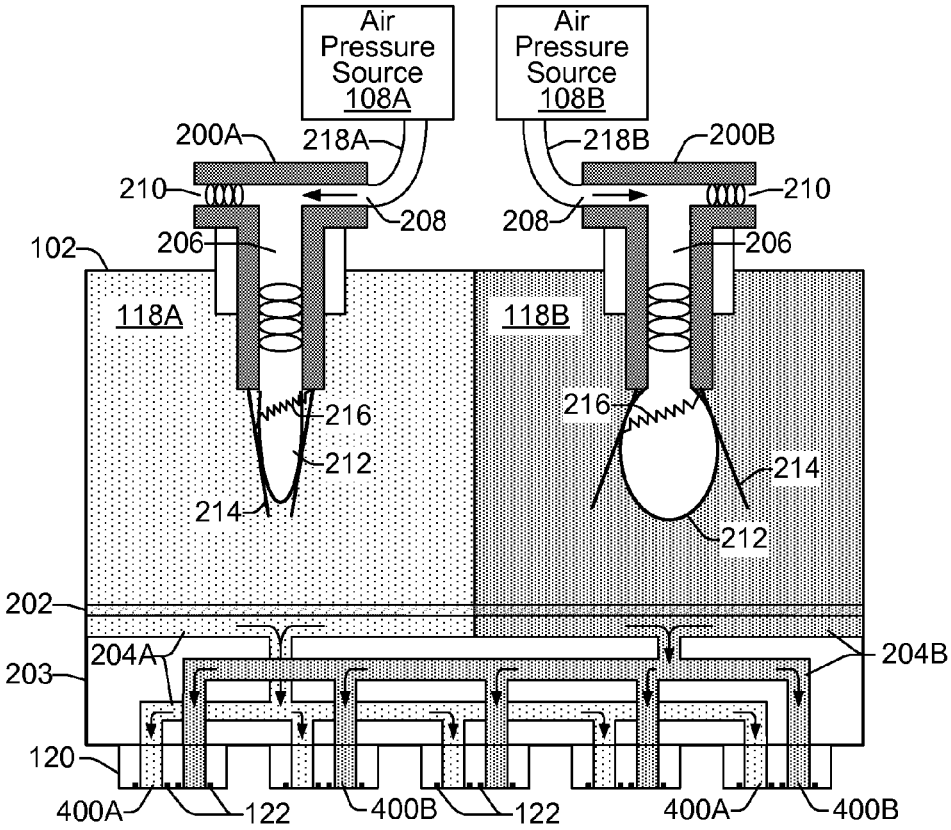
FIG. 6 shows a printhead module having two regulator chambers each operatively coupled to distinct air pressure sources, according to an embodiment.

FIG. 6 shows a printhead module 102 having two regulator chambers 118, each operatively coupled to distinct air pressure sources 108, according to an embodiment. The FIG. 6 embodiment enables simultaneous ejection events and priming events without affecting the ejected ink drops. Referring now to FIG. 6, the printhead module 102 is configured in mostly the same manner as the printhead module 102 discussed above with regard to FIGS. 2-5. However, the printhead module 102 of FIG. 6 includes two regulator/filter chambers 118A and 118B, instead of just a single regulator/filter chamber 118. Regulator chambers 118A and 118B serve as internal ink reservoirs 118A and 118B, to provide temporary storage of ink from ink supply 104 prior to ejecting the ink through nozzles 122. Regulator chambers 118A and 118B can have the same colored ink or they can have different colored ink. In addition, printhead module 102 has two pressure control regulators 200A and 200B that are each supported by distinct, respective air pressure sources 108A and 108B. The pressure control regulators 200A and 200B also correspond respectively to regulator chambers 118A and 118B.

The printhead module 102 of FIG. 6 includes one or more printheads 120 that each have two ink slots 400A and 400B corresponding respectively to regulator chambers 118A and 118B. More specifically, regulator chamber 118A is in fluid communication with ink slots 400A in printheads 120, and regulator chamber 118B is in fluid communication with ink slots 400B in printheads 120. Thus, ink ejected through nozzles 120 that are in nozzle columns adjacent to ink slots 400A is ink that comes from regulator chamber 118A, while ink ejected through nozzles 120 that are in nozzle columns adjacent to ink slots 400B is ink that comes from regulator chamber 118B. Printhead module 102 also generally includes a filter 202 to filter ink prior to the ink passing into printheads 120, and a die carrier 203 having manifold passages 204A and 204B through which the ink passes to reach printheads 120. While printheads 120 are discussed throughout this disclosure as having two ink slots 400 corresponding to either one or two regulator chambers 118 in a printhead module 102, the described principles apply equally to printheads 120 having different numbers of ink slots 400 corresponding to different numbers of regulator chambers 118 in a printhead module 102. For example, a printhead 120 may have four ink slots 400 where the first two ink slots are in fluid communication with a first regulator chamber in the printhead module, and where the second two ink slots are in fluid communication with a second regulator chamber in the printhead module.

Referring still to FIG. 6, nozzle priming events and drop ejection events can occur simultaneously without affecting ink drop quality because nozzles 120 associated with the two regulator chambers 118A and 118B can be primed independently. Thus, while nozzles 120 associated with regulator chamber 118B undergo a nozzle priming event, as shown in FIG. 6 for example, nozzles associated with regulator chamber 118A can eject ink drops without being influenced by the priming event. Printer controller 114 can control and coordinate when and where (i.e., with respect to which regulator chamber 118) both the priming events and the ejection events occur as between multiple regulator chambers 118 to ensure that drop ejection events do not occur in nozzles that are also experiencing a nozzle priming event.

In a manner similar to that discussed above regarding embodiments of FIGS. 2-5, a nozzle priming event in the FIG. 6 embodiment causes pressurized air pulses to be generated by an air pressure source 108A or 108B, as determined and controlled by printer controller 114. In the example of FIG. 6, air pressure source 108B is being controlled to generate the air pulses. Therefore, although the following discussion assumes a priming event occurring with respect to nozzles 120 that are fluidically associated with regulator chamber 118B, the discussion applies equally to a priming event occurring with respect to nozzles 120 that are fluidically associated with regulator chamber 118A. The air pulses from pressure source 108B pass through corresponding air tube 218B and into a regulator air bag 212 through vent openings 208 and 206 within corresponding regulator chamber 118B. The regulator bag 212 inflates as the pressure source 108B forces air pressure pulses through the air tube 218B and the vent openings 208 and 206. As the regulator bag 212 inflates, it displaces a small volume of ink within the chamber 118B. The ink displacement propagates through corresponding manifold passages 204B and ink slots 400B to the nozzles 122 in printheads 120, where it causes the ink meniscus in nozzles 122 to bulge. The ink displacement is sufficient to bulge the menisci in the nozzles associated with ink slots 400B, but it does not cause ink to be ejected from or drool from the nozzles 122. The bulging of the menisci disrupts any viscous plugs or crusting that may be forming within the nozzles 122 and thereby primes the nozzles 122 to be ready to eject ink drops without interference.

When the pressure source 108B stops forcing air pressure pulses through air tube 218B, the regulator springs 216 pulling against the regulator flaps 214 cause the regulator bag 212 in chamber 118B to deflate. The priming air pressure in the regulator bag 212 is pushed back out of the bag through vent opening 206, and then to ambient air via vent opening 210. The deflation of the regulator bag 212 allows the bulging meniscus to retract to its normal state again.

As noted above, during the nozzle priming event associated with regulator chamber 118B as just discussed, drop ejection events can occur in a simultaneous fashion through nozzles 122 associated with the regulator chamber 118A and corresponding ink slots 400A.

What is claimed is:

1. A printing system comprising:

a printhead module that includes a printhead and a regulator chamber, the chamber containing ink and a regulator air bag, wherein the air bag and the printhead are in fluid communication with the ink and the printhead includes a plurality of ejection nozzles; and a pressure source to inflate the air bag thereby displacing an amount of ink sufficient to agitate menisci in the nozzles without pushing ink out of the nozzles.

2. A system as in claim 1, further comprising a controller for controlling air pressure pulses from the pressure source that inflate the air bag.

3. A system as in claim 2, further comprising service instructions executable on the controller to control pulse lengths, dwell times and a number of pulses from the pressure source.

4. A system as in claim 3, wherein the service instructions are configured to determine the pulse lengths, dwell times and number of pulses based on operating characteristics of the printhead module.

5. A system as in claim 4, wherein the characteristics are selected from the group consisting of ink rheology, printhead architecture and operating temperature characteristics of the ink, the print module architecture, and an operating environment of the print module.

6. A system as in claim 1, wherein the pressure source comprises an ink pump configured to pump ink to the printhead module.

7. A method of operating a printhead module comprising:

forcing air pressure pulses into a first chamber of a printhead module;

inflating an air bag in the first chamber with the air pressure pulses;

displacing a volume of ink by inflating the air bag;

wherein displacing the volume of ink excites ink menisci in first ejection nozzles associated with the first chamber without pushing ink out of the first nozzles.

8. A method as in claim 7, wherein forcing air pressure pulses into the print module comprises:

generating the air pressure pulses with a pressure source; and directing the air pressure pulses through a pressure regulator vent of the print module.

9. A method as in claim 7, wherein generating the air pressure pulses comprises controlling pulse lengths, dwell times between pulses, and the number of pulses generated.

10. A method as in claim 9, wherein generating the air pressure pulses comprises determining the pulse lengths, dwell times and number of pulses based on characteristics of the ink, the print module architecture, and an operating environment of the print module.

11. A method as in claim 7, further comprising ejecting an ink drop from second ejection nozzles that are associated with a second chamber of the print module, wherein ejecting the ink drop is simultaneous with the excitation of the ink menisci.

12. A method as in claim 11, wherein ejecting an ink drop comprises pumping ink into the chamber of the print module with a pump that also generates the air pressure pulses.

13. A printing system comprising:

a printhead module;

a plurality of chambers in the module, each containing ink and an air bag;

a printhead having a plurality of ink slots, each ink slot in fluid correspondence with ink from one of the plurality of chambers;

a plurality of pressure sources, each associated with one of the chambers; and a controller to cause a first pressure source to inflate a first air bag in a first chamber to displace a volume of ink in the first chamber sufficient to agitate menisci in ejection nozzles adjacent a first ink slot without pushing ink out of the ejection nozzles.

14. A printing system as in claim 13, wherein the controller is configured to cause an ejection nozzle adjacent a second ink slot to eject an ink drop while causing the first pressure source to inflate a first air bag.

* * * * *